US006290506B1

(12) United States Patent
Milner

(10) Patent No.: US 6,290,506 B1
(45) Date of Patent: Sep. 18, 2001

(54) MODULAR JACK ASSEMBLY AND CONTACT ARRAY SUBASSEMBLY THEREFOR HAVING NON-PARALLEL INTERMEDIATE CONTACT AND DEFLECTION RESTRICTING SEAT

(75) Inventor: John J. Milner, Milford, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/443,836

(22) Filed: Nov. 19, 1999

(51) Int. Cl.[7] ..... H01R 4/50
(52) U.S. Cl. ..... 439/3; 439/676; 439/941
(58) Field of Search ..... 439/676, 344, 439/660, 941, 76, 78

(56) References Cited

U.S. PATENT DOCUMENTS 5,061,209 * 10/1991 Bollick et al. ..... 439/676
5,399,107 * 3/1995 Gentry et al. ..... 439/676
5,647,770 * 7/1997 Belopolsky ..... 439/676

OTHER PUBLICATIONS

Publication entitled "Hubbell Premise Wiring Full Line Catalog", p. 4 (undated).

* cited by examiner

*Primary Examiner*—Paula Bradley
*Assistant Examiner*—Alexander Gilman
(74) *Attorney, Agent, or Firm*—Michael R. Swartz

(57) ABSTRACT

An enhanced modular jack assembly includes a contact array subassembly having a circuit board, a plurality of long and short contacts, an intermediate contact and a seat structure. The long and short contacts are attached to and extend forwardly from the circuit board and are arranged in pairs of the long and short contacts situated in spaced-apart substantially parallel front and back rows in which the long contacts of the back row are aligned with one another and the short contacts of the front row are aligned with one another but are offset relative to the long contacts of the back row. The intermediate contact is attached to and extends forwardly from the circuit board and has a length substantially the same as the length of the short contacts and a non-parallel orientation relative to the long and short contacts of the back and front rows. The seat structure is disposed upright between the circuit board and the intermediate and short contacts but only engages the intermediate contact so as to restrict deflection of a lower portion of the intermediate contact extending from the seat structure to the circuit board but allow deflection of an upper portion of the intermediate contact extending beyond the seat structure.

12 Claims, 3 Drawing Sheets

MODULAR JACK ASSEMBLY AND CONTACT ARRAY SUBASSEMBLY THEREFOR HAVING NON-PARALLEL INTERMEDIATE CONTACT AND DEFLECTION RESTRICTING SEAT

BACKGROUND OF THE INVENTION

1. Field of the Invention

The present invention generally relates to cabling systems for supporting high-speed full duplex digital transmission protocols and, more particularly, is concerned with an enhanced modular jack assembly for use in such cabling systems and having a contact array subassembly with a non-parallel intermediate contact and a seat restricting deflection of the intermediate contact.

2. Description of the Prior Art

Network transmission rates have increased hundred fold during the past five years. These increases have prompted standards organizations to draft performance standards covering cabling systems that will ensure that such cabling systems are capable of supporting full duplex digital transmission protocols. These performance standards specify near end cross talk, power sum near end cross talk, attenuation, and return loss electrical performance across the interconnection device interface to ensure the channel performance is maintained to digital transmission protocols. These performance standards require separation of pairs in the unshielded twisted pairs cabling. These standards also require separation and isolation of contacts in the interconnection devices.

Heretofore, Hubbell Premise Wiring of Stonington, Conn., a subsidiary of Hubbell Incorporated, has manufactured and marketed an interconnection device in the form of a modular jack. assembly for use in these cabling systems. The modular jack assembly has an array of contacts which includes pairs of long and short contacts mounted on a circuit board and connected to the four unshielded twisted pairs in the cabling. The pairs of long and short contacts are situated in spaced-apart substantially parallel first and second rows in which the long contacts of the first row are aligned with one another and the short contacts of the second row are aligned with one another but are offset relative to the long contacts of the first row. The contacts of both rows have generally hook-shaped configurations with substantially straight inner portions extending generally upright from the circuit board, substantially straight outer portions extending generally forwardly and downwardly at acute angles relative to the inner portions and the circuit board and substantially rounded or arcuate-shaped middle portions rigidly interconnecting the straight inner and outer portions. The inner and middle portions of the long contacts of the first row are longer than the inner and middle portions of the short contacts of the front row such that the middle portions of the long contacts of the first row are disposed above but offset from the middle portions of the short contacts of the second row. The outer portions of the long contacts of the first row extend toward the circuit board at a steeper acute angle than the outer portions of the short contacts of the second row such that the outer portions of the long contacts of the first row extend between the outer portions of the short contacts of the second row and have free ends which protrude beyond the adjacent free ends of the outer portions of the short contacts of the second row.

The above-described modular jack assembly produced by Hubbell Premise Wiring has met the prior industry performance standards and achieved substantial commercial success. However, innovations are now needed to this modular jacket assembly in order to meet the aforementioned new increased performance standards.

SUMMARY OF THE INVENTION

The present invention provides an enhanced modular jack assembly and contact array subassembly designed to satisfy the aforementioned need. The enhanced modular jack assembly and the contact array subassembly therefor of the present invention incorporate an intermediate contact which replaces one of the long contacts of the prior art modular jack assembly and has a length substantially the same as the length of one of the short contacts. Particularly, the intermediate contact replaces an end one of the long contacts. The intermediate contact enables the desired specific levels of near end cross talk, power sum near end cross talk, attenuation and return loss electrical performance across the interconnection device interface to be achieved. The intermediate contact reduces unwanted crosstalk noise when mated to a plug due to the geometry of the intermediate contact relative to the adjacent long and short contacts of the first and second rows.

Accordingly, the present invention is directed to an enhanced modular jack assembly and a contact array subassembly therefor which comprise a plurality of long and short contacts mounted to the circuit board in first and second rows and an intermediate contact having a length substantially the same as a length of one of the short contacts and mounted to the circuit board in the first row and extending therefrom to the first row and being disposed at a shallow acute angle relative to the long contacts of the first row and the short contacts of the second row. The intermediate contact has an inner portion mounted on the circuit board in the first row of long contacts and extending in an upward and forward inclined orientation relative to the circuit board from the first row of long contacts to the second row of short contacts to a middle portion of the intermediate contact disposed in the second row of short contacts. The enhanced modular jack assembly and contact array subassembly therefor also comprise a seat structure disposed upright between the circuit board and the middle portions of the short contacts of the second row and the middle portion of the intermediate contact but only engaging the middle portion of the intermediate contact so as to restrict deflection of the inner portion of the intermediate contact while allowing deflection of the outer portion thereof.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
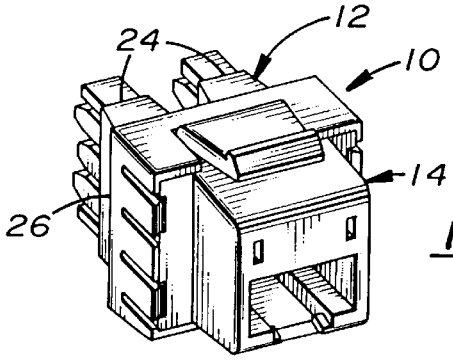
FIG. 1 is a front perspective view of an enhanced modular jack assembly of the present invention showing front and rear housings of the enhanced assembly mated together.
Figure 3:
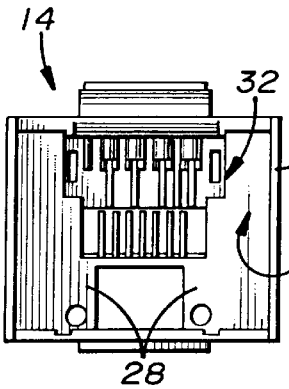
FIG. 3 is a rear elevational view of the front housing as seen along line 3—3 of FIG. 2.
Figure 2:
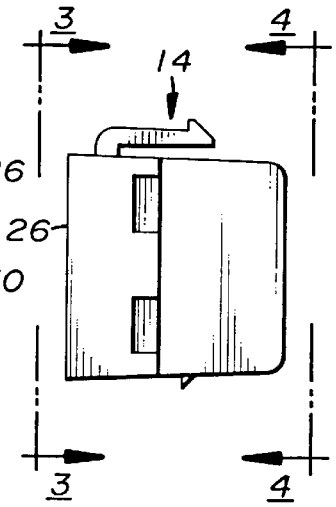
FIG. 2 is a side elevational view of the front housing of the enhanced assembly of FIG. 1.
Figure 4:
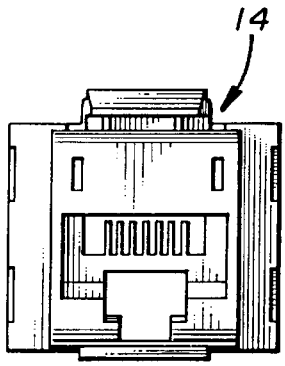
FIG. 4 is a front elevational view of the front housing as seen along line 4—4 of FIG. 2.
Figure 5:
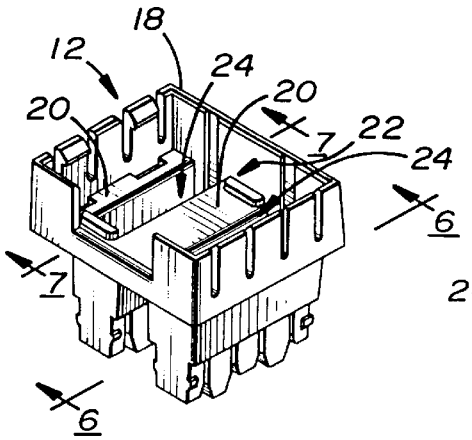
FIG. 5 is a front perspective view of the rear housing of the enhanced assembly of FIG. 1.
Figure 6:
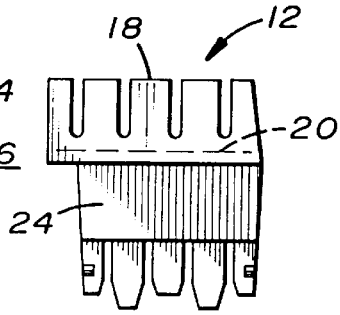
FIG. 6 is a side elevational view of the rear housing as seen along line 6—6 of FIG. 5.
Figure 7:
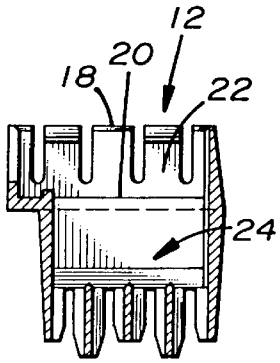
FIG. 7 is a sectional view of the rear housing taken along line 7—7 of FIG. 5.
Figure 8:
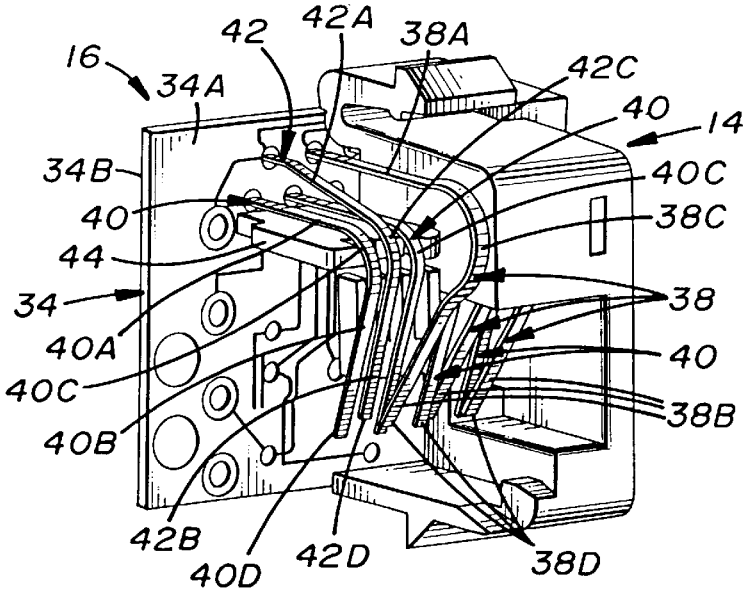
FIG. 8 is a fragmentary front perspective view of the front housing and also of a contact array subassembly of the present invention inserted into the front housing and including a printed circuit board, an array of long, short and intermediate contacts mounted thereto and a seat structure inserted between the contacts and printed circuit board.
Figure 9:
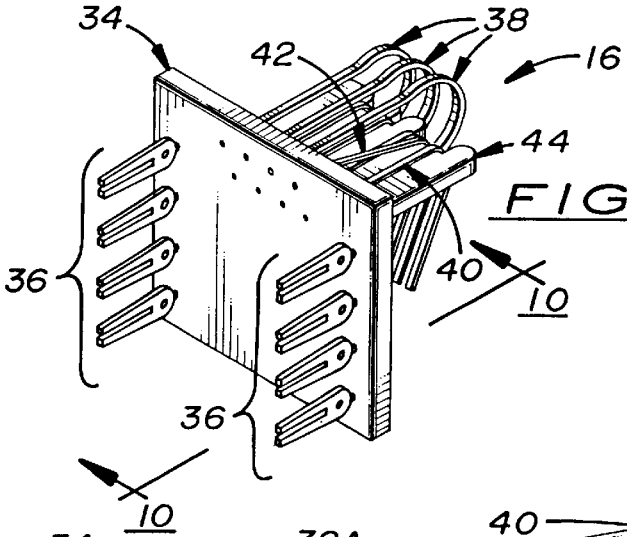
FIG. 9 is a rear perspective view of the contact array subassembly.
Figure 10:
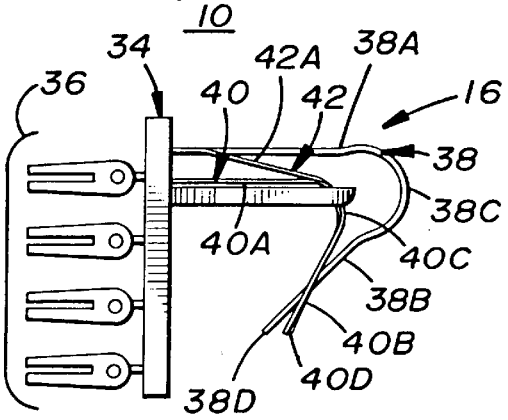
FIG. 10 is a side elevational view of the contact array subassembly as seen along line 10—10 of FIG. 9.
Figure 11:
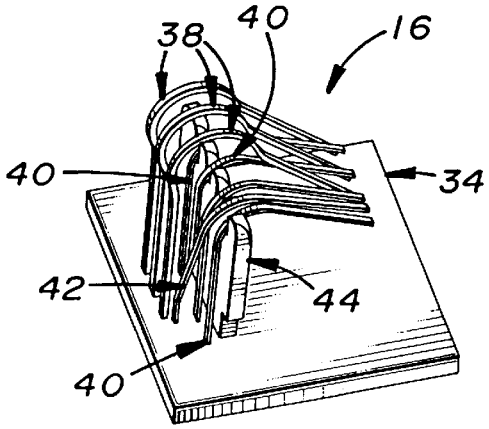
FIG. 11 is a front perspective view of the contact array subassembly.
Figure 13:
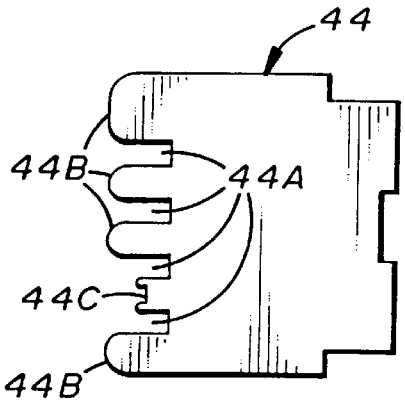
FIG. 13 is a plan view of the seat structure.
Figure 12:
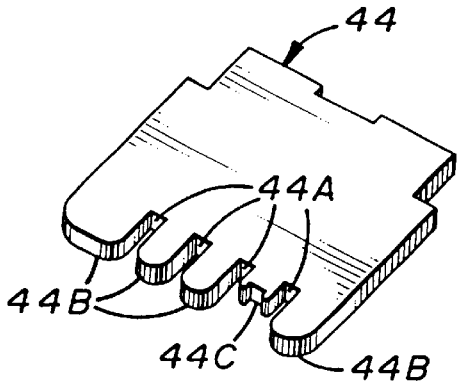
FIG. 12 is an enlarged perspective of the seat structure of the contact array subassembly.
Figure 16:
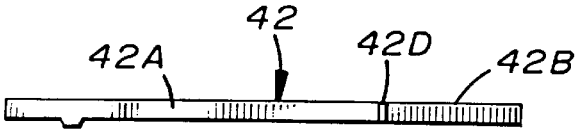
FIG. 16 is a front elevational view of the intermediate contact as seen along line 16—16 of FIG. 14.
Figure 14:
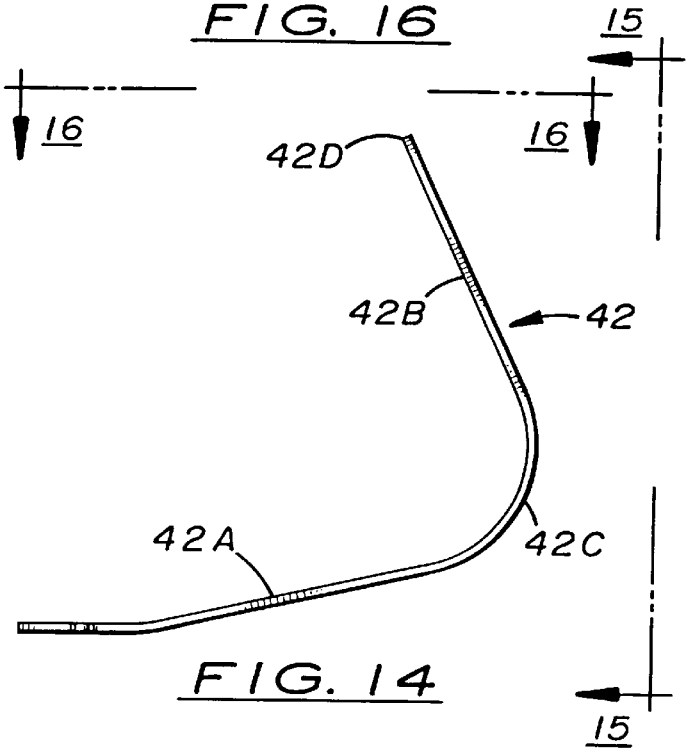
FIG. 14 is a side elevational view of an intermediate contact of the contact array subassembly.
Figure 15:
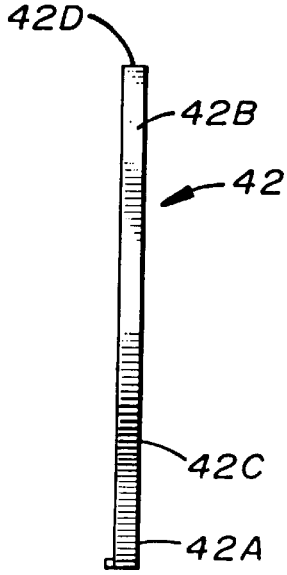
FIG. 15 is a top end view of the intermediate contact as seen along line 15—15 of FIG. 14.

In the following description, like reference characters designate like or corresponding parts throughout the several views of the drawings. Also in the following description, it is to be understood that such terms as "front", "rear", "inner" and "outer", "upper", "lower" and the like are words of convenience and are not to be construed as limiting terms.

Referring to the drawings and particularly to FIGS. 1 to 8, there is illustrated an enhanced modular jack assembly, generally designated 10, for use in cabling systems supporting high-speed full duplex digital transmission protocols. The enhanced jack assembly 10 basically includes a rear housing 12, a front housing 14 and a contact array subassembly 16. The rear and front housings 12, 14 of the enhanced jack assembly 10 are substantially similar in construction and configuration to the front and rear housings of the prior art jack assembly. The contact array subassembly 16 of the enhanced jack assembly 10 is modified in construction and configuration from the contact array subassembly of the prior art jack assembly and thus constitutes the present invention.

Referring to FIGS. 1 to 7, the rear and front housings 12, 14 of the enhanced jack assembly 10 are made of a suitable non-conductive material. The rear housing 12 has a front opening 18, an interior front surface 20 facing toward and recessed rearwardly from the front opening 18, a rear cavity 22 formed between the front opening 18 and the interior front surface 20, and rear compartment means 24 extending rearwardly of the interior front surface 20. The front housing 14 has a rear opening 26, an interior rear surface 28 facing toward and recessed forwardly from the rear opening 26, a front cavity 30 formed between the rear opening 26 and the interior rear surface 28, and front compartment means 32 extending forwardly of the interior rear surface 28. The front housing 14 is mateable with the rear housing 12, as seen in FIG. 1, such that the interior rear surface 28 of the front housing 14 is disposed in a spaced relationship with the interior front surface 20 of the rear housing 12.

Referring to FIGS. 8 to 11, the contact array subassembly 16 includes a circuit board 34, a plurality of terminals 36, a plurality of long and short contacts 38, 40, and an intermediate contact 42. The circuit board 34 has a generally flat shape and opposite front and rear sides 34A, 34B. The circuit board 34 is adapted to fit within the space between the interior front surface 20 of the rear housing 12 and the interior rear surface 28 of the front housing 14 and to be supported by the rear and front housings 12, 14 when the front housing 14 is mated with the rear housing 12. The terminals 36 are attached to and extend rearwardly from the rear side 34B of the circuit board 34 so as to extend into the rear compartment means 24 of the rear housing when the front housing 14 is mated with the rear housing 12 and the circuit board 34 is disposed and supported therebetween. The long and short contacts 38, 40 are mounted to and extend upwardly from the front side 34A of the circuit board 34 so as to extend into the front compartment means 32 of the front housing 14 when the front housing 14 is mated with the rear housing 12 and the circuit board 34 is disposed and supported therebetween. The long and short contacts 38, 40 are arranged in pairs thereof situated in spaced-apart substantially parallel first and second rows in which the long contacts 38 of the first row are aligned with one another and the short contacts 40 of the second row are aligned with one another but are offset relative to the long contacts 38 of the first row. The intermediate contact 42 is mounted to the interior front side 20 of the circuit board 34 in the first row of the long contacts 38 and extends therefrom into the front compartment means 32 of the front housing 14 with the long and short contacts 38, 40. The intermediate contact 42 also extends from the first row of the long contacts 38 to the second row of the short contacts 40.

More particularly, each of the long, short and intermediate contacts 38, 40, 42 has a generally hook-shaped configuration and substantially straight inner and outer portions 38A and 38B, 40A and 40B, 42A and 42B and a substantially rounded or arcuate-shaped middle portion 38C, 40C, 42C rigidly interconnecting the straight inner and outer portions. The straight inner portions 38A, 40A of the long and short contacts 38, 40 extend generally upright from the circuit board 34. The straight outer portions 38B, 40B of the long and short contacts 38, 40 extend generally forwardly and downwardly at an acute angle relative to the inner portions 38A, 40A and to the circuit board 34. The inner and middle portions 38A, 38C of the long contacts 38 of the first row are longer than the inner and middle portions 40A, 40C of the short contacts 40 of the second row such that the middle portions 38C of the long contacts 38 of the first row are disposed above but offset from the middle portions 40C of the short contacts 40 of the second row. Furthermore, the outer portions 38B of the long contacts 38 of the first row extend toward the circuit board 34 at a steeper acute angle than the outer portions 40B of the short contacts 40 of the second row such that the outer portions 38B of the long contacts 38 of the first row extend between the outer portions 40B of the short contacts 40 of the second row. The outer portions 38B of the long contacts 38 of the first row have free ends 38D which protrude beyond adjacent free ends 40D of the outer portions 40B of the short contacts 40 of the second row.

The inner portion 42A of the intermediate contact 42 is attached on the circuit board 34 in the first row and extends in a non-parallel orientation relative to the long and short contacts 38, 40 of the first and second rows. More particularly, the inner portion 42A of the intermediate contact 42 extends in an upward and forward inclined orientation from the first row of the long contacts 38 to the second row of the short contacts 40. The inner portion 42A of the intermediate contact 42 is disposed at a shallow acute angle relative to the long contacts 38 of the first row and the short contacts 40 of the second row. The intermediate contact 42 of the subassembly 16 of the enhanced jack assembly 10 replaces an end one of the long contacts 38 of the prior art jack assembly. The intermediate contact 42 has a length substantially the same as the lengths of the short contacts 40. The outer portion 42B of the intermediate contact 42 extends generally forwardly and downwardly at an acute angle relative to its inner portion 42A and the circuit board 34. The middle and outer portions 42C, 42B of the intermediate contact 42 are disposed in the second row and generally aligned with the middle and outer portions 40C, 40B of the short contacts 40.

The contact array subassembly 16 also includes a contact seat structure 44 having a planar configuration and being disposed upright between the circuit board 34 and the middle portions 40C of the short contacts 40 of the second row and the middle portion 42C of the intermediate contact 42. However, the seat structure 44 has slots 44A recessed in an upper edge 44B thereof which receive the middle portions 40C of the short contacts 40 without the upper edge 44B engaging the short contacts 40. The seat structure 44 has a raised land 44C aligned with the middle portion 42C of the intermediate contact 42 which engages the intermediate contact 42 so as to restrict deflection of the inner portion 42A of the intermediate contact 42 but allow deflection of the outer portion 42B thereof.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A contact array subassembly for use in a modular jack assembly, said subassembly comprising:

(a) a circuit board;

(b) a plurality of long and short contacts mounted to and extending from said circuit board and being arranged in pairs of said long and short contacts situated in spaced-apart substantially parallel first and second rows in which said long contacts of said first row are aligned with one another and said short contacts of said second row are aligned with one another but are offset relative to said long contacts of said first row, each of said long and short contacts having a substantially straight inner portion extending generally upright from said circuit board, a substantially straight outer portion extending generally forwardly and downwardly at an acute angle relative to said inner portion and said circuit board and a substantially rounded middle portion rigidly interconnecting said straight inner and outer portions, said outer portions of said long contacts of said first row having free ends which protrude beyond adjacent free ends of said outer portions of said short contacts of said second row; and (c) an intermediate contact mounted to said circuit board in said first row and extending therefrom to said second row in a non-parallel orientation relative to said long and short contacts and being disposed at a shallow acute angle relative to said long contacts of said first row and said short contacts of said second row, said intermediate contact having an inner portion mounted on said circuit board in said first row and extending in an upward and forward inclined orientation from said first row of said long contacts to said second row of said short contacts, an outer portion extending generally forwardly and downwardly at an acute angle relative to said inner portion and said circuit board and a substantially rounded middle portion rigidly interconnecting said inner and outer portions, said middle and outer portions of said intermediate contact being disposed in said second row and generally aligned with said middle and outer portions of said short contacts.

2. The subassembly as recited in claim 1, further comprising:

a seat structure disposed upright between said circuit board and said intermediate and short contacts but only engaging said intermediate contact so as to restrict deflection of an inner portion of said intermediate contact extending from said seat structure to said circuit board but allow deflection of an outer portion of said intermediate contact extending beyond said seat structure.

3. The subassembly as recited in claim 1, wherein each of said long, short and intermediate contacts has a generally hook-shaped configuration.

4. The subassembly as recited in claim 1, wherein said inner and middle portions of said long contacts of said first row are longer than said inner and middle portions of said short contacts of said second row such that said middle portions of said long contacts of said first row are disposed above but offset from said middle portions of said short contacts of said second row.

5. The subassembly as recited in claim 3, wherein said outer portions of said long contacts of said first row extend toward said circuit board at a steeper acute angle than said outer portions of said short contacts of said second row such that said outer portions of said long contacts of said first row extend between said outer portions of said short contacts of said second row.

6. The subassembly as recited in claim 1, further comprising:

a seat structure disposed upright between said circuit board and said middle portions of said short contacts of said second row and said middle portion of said intermediate contact but only engaged with said middle portion of said intermediate contact so as to restrict deflection of said inner portion of said intermediate contact but allow deflection of said outer portion thereof.

7. An enhanced modular jack assembly, comprising:

(a) a rear housing having a front opening, an interior front surface facing toward and recessed rearwardly from said front opening, a rear cavity formed between said front opening and said interior front surface, and rear compartment means extending rearwardly of said interior front surface;

(b) a front housing having a rear opening, an interior rear surface facing toward and recessed forwardly from said rear opening, a front cavity formed between said rear opening and said interior rear surface, and front compartment means extending forwardly of said interior rear surface, said front housing being mateable with said rear housing such that said rear surface of said front housing is disposed in a spaced relationship with said front surface of said rear housing; and (c) a contact array subassembly including (i) a circuit board having a generally flat shape and opposite front and rear sides and adapted to fit between said front surface of said rear housing and said rear surface of said front housing with said front housing mated with said rear housing;

(ii) a plurality of terminals attached to and extending rearwardly from said rear side of said circuit board so as to extend into said rear compartment means of said rear housing with said front housing is mated with said rear housing and said circuit board disposed therebetween;

(iii) a plurality of long and short contacts mounted to and extending upwardly from said upper side of said circuit board so as to extend into said front compartment means of said front housing with said front housing mated with said rear housing and said circuit board disposed therebetween, said contacts being arranged in pairs of long and short contacts situated in spaced-apart substantially parallel first and second rows in which said long contacts of said first row are aligned with one another and said short contacts of said second row are aligned with one another but are offset relative to said long contacts of said first row, each of said long and short contacts having a substantially straight inner portion extending generally upright from said circuit board, a substantially straight outer portion extending generally forwardly and downwardly at an acute angle relative to said inner portion and said circuit board and a substantially rounded middle portion rigidly interconnecting said straight inner and outer portions, said outer portions of said long contacts of said first row having free ends which protrude beyond adjacent free ends of said outer portions of said short contacts of said second row; and (iv) an intermediate contact mounted to said front side of said circuit board in said first row of said long contacts, said intermediate contact extending therefrom into said front compartment means of said front housing to said second row of said short contacts in a non-parallel orientation relative to said long and short contacts and being disposed at a shallow acute angle relative to said long contacts of said first row and said short contacts of said second row, said intermediate contact having an inner portion mounted on said circuit board in said first row and extending in an upward and forward inclined orientation from said first row of said long contacts to said second row of said short contacts, an outer portion extending generally forwardly and downwardly at an acute angle relative to said inner portion and said circuit board and a substantially rounded middle portion rigidly interconnecting said inner and outer portions, said middle and outer portions of said intermediate contact being disposed in said second row and generally aligned with said middle and outer portions of said short contacts.

8. The assembly as recited in claim 5, further comprising:

a seat structure disposed upright between said circuit board and said intermediate and short contacts but only engaging said intermediate contact so as to restrict deflection of an inner portion of said intermediate contact extending from said seat structure to said circuit board but allow deflection of an outer portion of said intermediate contact extending beyond said seat structure.

9. The assembly as recited in claim 5, wherein each of said long, short and intermediate contacts has a generally hook-shaped configuration.

10. The assembly as recited in claim 5, wherein said inner and middle portions of said long contacts of said first row are longer than said inner and middle portions of said short contacts of said second row such that said middle portions of said long contacts of said first row are disposed above but offset from said middle portions of said short contacts of said second row.

11. The assembly as recited in claim 7, wherein said outer portions of said long contacts of said first row extend toward said circuit board at a steeper acute angle than said outer portions of said short contacts of said second row such that said outer portions of said long contacts of said first row extend between said outer portions of said short contacts of said second row.

12. The subassembly as recited in claim 5, further comprising:

a seat structure disposed upright between said circuit board and said middle portions of said short contacts of said second row and said middle portion of said intermediate contact but only engaged with said middle portion of said intermediate contact so as to restrict deflection of said inner portion of said intermediate contact but allow deflection of said outer portion thereof.

* * * * *